United States Patent [19]

Paterson

[11] 4,121,815

[45] Oct. 24, 1978

[54] CLAMPS

[76] Inventor: Roy Alan Paterson, Princes Highway, Littlehampton, S.A., Australia

[21] Appl. No.: 848,274

[22] Filed: Nov. 3, 1977

[30] Foreign Application Priority Data

Nov. 5, 1976 [AU] Australia ..... 8029/76

[51] Int. Cl.[2] ..... B25B 1/02

[52] U.S. Cl. ..... 269/203

[58] Field of Search ..... 269/203, 238, 240, 189, 269/166–171.5

[56] References Cited

U.S. PATENT DOCUMENTS

| | | | |
|---|---|---|---|
| 3,441,265 | 4/1969 | Albert | 269/203 |
| 3,758,100 | 9/1973 | Taylor et al. | 269/203 |

FOREIGN PATENT DOCUMENTS

| | | | |
|---|---|---|---|
| 1,335,568 | 7/1963 | France | 269/203 |

*Primary Examiner*—Robert C. Watson

*Attorney, Agent, or Firm*—Jay L. Chaskin

[57] ABSTRACT

The clamp comprises an L-shaped fixed member and an L-shaped sliding member retained by a loop thereon to be slidable along the post portion of the fixed member. A clamping screw threadably engages the slide bar portion of the sliding member above the loop, and bears against the inner surface of the post.

When the sliding member first engages a workpiece it tilts only slightly, and in an anticlockwise direction as illustrated in FIG. 1. Upon tightening of the clamping screw, the sliding member is tilted slightly but in a clockwise direction, correcting the initial tilt and maintaining the jaws substantially parallel.

Since the clamping screw bears against the post with a greater pressure than the pressure applied to the workpiece, the clamp does not rely upon tilting to grip the post.

6 Claims, 3 Drawing Figures

CLAMPS

This invention relates to improvements in clamps of the type having a fixed arm, a post extending therefrom, a sliding arm having a loop with edges which grip a post upon pressure being applied to the outer end of the sliding arm, and a screw threaded clamping member.

BACKGROUND OF THE INVENTION

Clamps which embody these features are well known and are in common use, frequently being known as "cramps" or "carpenter's clamps", and examples of such clamps can be seen in the U.S. Pat. Nos. 237,431 (1881) Colt; 248,949 (1881) Pope; 674,278 (1901) McNutt.

One object of this invention is to provide improvements in clamps of this type which will be particularly useful in facilitating the clamping of materials, including materials which are not flat, and which will be inexpensive in its production.

There is frequently a need to use clamps of the abovementioned type for the clamping together of round material to flat material, round material to round material, and other combinations for which the existing clamps are not suitable. Because of the large angle of tilt of the sliding arm, clamps as presently used employ a swivel jaw thereon, but the swivel jaw frequently frictionally engages the screw threaded clamping means and makes it difficult to clamp two workpieces together without dislodgement, and another object of this invention is to provide improvements wherein it is unnecessary for either jaw to swivel.

If provision of a swivel jaw is not made on a prior art clamp, one jaw will tilt excessively with respect to the other upon tightening of the clamp, resulting in uneven pressures if applied to a flat workpiece, and a further object of this invention is to provide improvements wherein the tilting is reduced to insignificant proportions.

BRIEF SUMMARY OF THE INVENTION

Briefly in this invention there is provided a fixed member having a fixed arm and post defining an L-shape, a sliding member having a movable arm and slide bar also defining an L-shape, the slide bar being shorter in length than the post, a loop secured to the sliding member near its arm extending around the post and retaining a surface of the slide bar in sliding engagement with a surface of the post, and a clamping screw threadably engaging the slide bar near its end and arranged to apply pressure to the front face of the post so as to slightly tilt the sliding member upon tightening of the screw, which causes only a small clamping movement of the movable arm towards the fixed arm.

For slight tilting to take place there must of course be a smaller degree of clearance between the post and the slide bar, but the nature of the device is such that initial positioning of the two arms on a workpiece assembly tilts the movable arm slightly in one direction, while tightening tilts it in the other direction thereby at least tending to correct the initial tilt.

If the distance between the clamping screw and the elbow contact point on the post is less than the distance from the post inner surface and the workpiece, the mechanical advantage favours the loop to post engagement with a greater pressure than the pressure on the workpiece, and, in contrast with some prior art clamps, this pressure increases upon tightening of the clamping screw, so that danger of reaction against the workpiece causing sliding of the sliding member upon clamp conditions obtaining. This in turn reduces the necessary clearance between post and slide bar so that tilting can be minimal, for example, only enough to correct the initial tilt.

In order to achieve the feature of being able to readily clamp together sections which are not necessarily flat sections, in another aspect of this invention the movable jaw, the fixed jaw, or both are provided with recesses of V formation adapted to engage a round section member for example at spaced points and thereby reduce probability of dislodgement.

More specifically, in this invention a clamp comprises a fixed member having a fixed arm and a post defining an L-shape, a sliding member having a movable arm and a slide bar also defining an L-shape, the slide bar being shorter than the post, a loop secured to the sliding member near its arm extending around the post and retaining a surface of the slide bar in sliding engagement with a surface of the post with the movable arm in the same plane as the fixed arm, and a clamping screw also in said plane threadably engaging the slide bar between its end and the loop and arranged, upon tightening, to bear against said surface of the post.

With this arrangement the loop where it engages the post forms a pivot point, and the movable jaw is caused to pivot on a relatively large radius so that its angle of tilt varies by a relatively small amount as clamping is effected, but since the clamping screw bears hard against the post inner surface to effect clamping, in contrast to prior art clamps, tilting of the sliding member is not essential to lock the sliding member with respect to the post.

BRIEF DESCRIPTION OF THE DRAWINGS

An embodiment of the invention is described hereunder in some detail with reference to and is illustrated in the accompanying drawings, in which.

Figure 1:
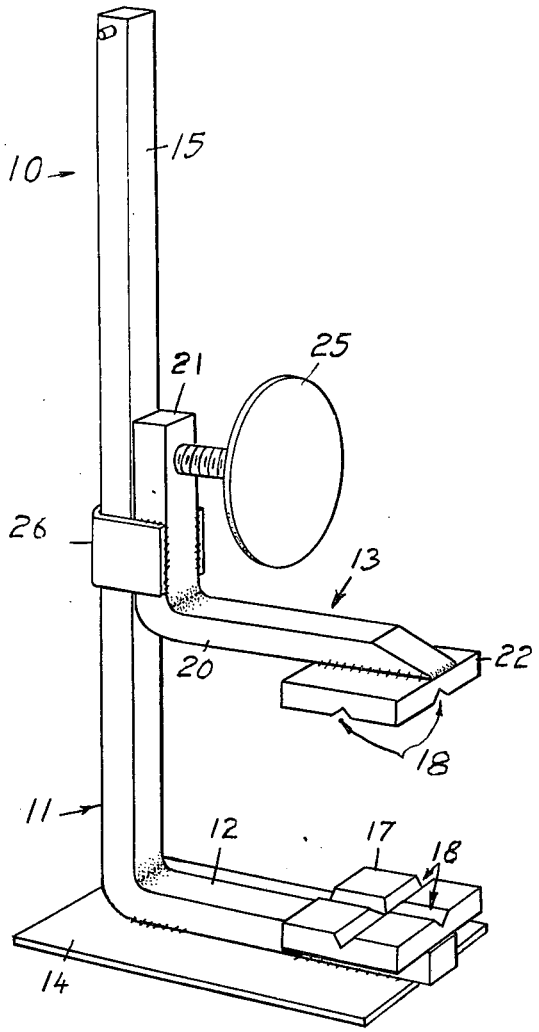
FIG. 1 is a perspective view of a clamp.
Figure 2:
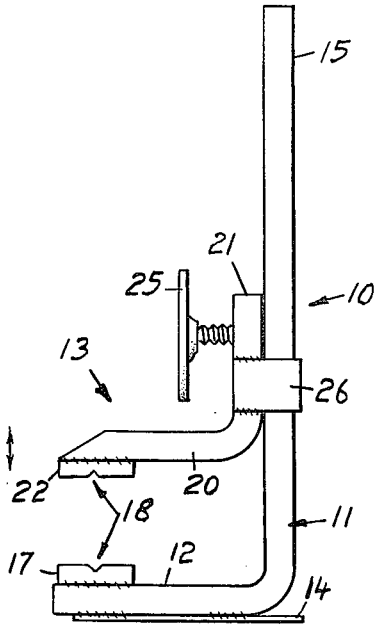
FIG. 2 is a side elevation.
Figure 3:
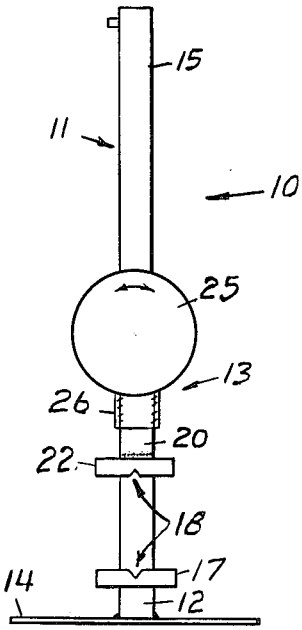
FIG. 3 is a front elevation.

In this embodiment a clamp 10 is formed to have a fixed memeber 11 a fixed arm 12, and a sliding member 13, the fixed arm 12 being secured to a base plate 14 by which it may be clamped to a bench, the fixed arm 12 being a horizontal portion of an L-shaped bar, the vertical portion of which constitutes a post 15. The end of the fixed arm 12 remote from the post 15 has a block secured thereto which constitutes a jaw 17, the jaw 17 being provided with two V-shaped grooves 18 intersecting one another at right angles.

The sliding member 13 also comprises an L-shaped bar, having a horizontal movable arm 20 and a vertical slide bar 21, the vertical slide bar 21 however being very much shorter in length than the post 15. The horizontal movable arm 20 is provided with a movable jaw 22 complementary to the fixed jaw 17 and of similar configuration, also containing V-shaped grooves 18. The sliding member 13 is, like the fixed member 11, formed from a single length of metal bent to an L-shape, and is symmetrical about the same central vertical plane, the upper end of the vertical slide bar containing a threaded aperture which is threadably engaged by a clamping screw 25, the head of the clamping screw extending forwardly of the vertical slide bar 21. The rear face of the vertical slide bar 21 lies substantially contiguous with the front face of the post 15, being retained in that position by means of a loose fitting loop 26 which extends around the post 15 at a location below the clamping screw 25 and adjacent the commencement of the elbow between the slide bar 21 and the arm 20. With this arrangement, the weight of the movable arm 20 and jaw 22 cause only slight tilting when the sliding arm is freely located on the post 15 as shown in FIG. 1, and there is a relatively large horizontal component of force urging the loop 26 against the rear surface of the post 15, so that the centre of gravity of the movable arm causes the arm to firmly grip the front and rear surfaces of the post when no load is applied, this greatly facilitating locating the movable arm with respect to the fixed arm. However, the movable arm is quickly and easily moved with the loop sliding over the post, by merely compensating for the weight of the arm.

When a workpiece is to be clamped, the sliding member 13 is moved until its movable jaw 22 engages one surface of a workpiece, the fixed jaw 17 engaging another surface of the workpiece or a second workpiece in contact therewith. By further movement of the movable jaw, it is tilted in one direction (anticlockwise in FIG. 1). By actuating the clamping screw 25 to bear hard against the front surface of post 15, the movable jaw 22 is caused to slightly tilt (in a compensating clockwise direction) about the loop 26 where it engages the rear surface of the post 15, thus firmly clamping the workpiece with jaws which are substantially parallel. It should be noted that the clamping is effected by tilting in the opposite direction from the tilting which takes place with carpenter's clamps or clamps which have been described above as prior art, and since clamping also to tilt the movable jaw in the opposite direction to any movement caused by strain of the clamp members, the parallel condition existing between the jaws is varied by a smaller amount.

A brief consideration of the above embodiment will indicate that the invention is exceedingly simple, the clamp made according to it is inexpensive, and yet the clamp can be constructed to be rugged and capable of withstanding severe use in a workshop.

I claim:

1. A clamp comprising a fixed member having a fixed arm and a post defining an L-shape, a sliding member having a slide bar and a movable arm extending away from said slide bar in the same direction as said fixed arm, said sliding member defining an L-shape, said slide bar being shorter than said post and extending in a direction away from said fixed arm, a loop secured to said slide bar near said movable arm extending around said post and retaining a surface of said slide bar in sliding engagement with a surface of said post with said movable arm in the same plane as said fixed arm and, a clamping screw in said plane threadably engaging said slide bar between its end and said loop, said clamping screw extending in the same direction as said movable arm from said slide bar, and arranged, upon tightening, to bear against said surface of said post so as to tilt said movable arm towards said fixed arm.

2. A clamp according to claim 1 wherein said fixed arm and post comprise a single bar of metal, and wherin said movable arm and slide bar comprise a single bar of metal.

3. A clamp according to claim 1 wherein said fixed arm has a base plate thereon.

4. A clamp according to claim 1 wherein said end of said fixed arm comprises a fixed jaw, and said end of said movable arm comprises a movable jaw which is co-operable with said fixed jaw.

5. A clamp according to claim 5 wherein each of said jaws comprises walls defining a V-shaped groove.

6. A clamp according to claim 1 wherein the distance between the axis of said clamping screw and the centre of said loop is less than the length of the movable arm.

* * * * *